United States Patent [19]

Gautier

[11] 4,164,308

[45] Aug. 14, 1979

[54] LADY'S HANDBAG

[76] Inventor: Francisco Gautier, c/o University Club, 1 W. 54th St., New York, N.Y. 10019

[21] Appl. No.: 953,290

[22] Filed: Oct. 20, 1978

[51] Int. Cl.[2] ..... A45C 1/04

[52] U.S. Cl. ..... 224/45 R; 224/202; 190/42; 150/47; 224/240; 224/235; 224/253

[58] Field of Search ..... 24/3; 190/42, 61; 150/47; 224/26 R, 26 K, 26 H, 26 F, 26 D, 5 R, 5 A, 5 G, 8 R, 9, 46 R, 47

[56] References Cited

U.S. PATENT DOCUMENTS

| | | | |
|---|---|---|---|
| 225,088 | 3/1880 | Whitenack | 150/47 |
| 4,046,296 | 9/1977 | McGhee | 224/26 D |

FOREIGN PATENT DOCUMENTS

| | | | |
|---|---|---|---|
| 729549 | 4/1932 | France | 150/47 |
| 226678 | 1/1925 | United Kingdom | 150/47 |

*Primary Examiner*—Ro E. Hart
*Attorney, Agent, or Firm*—C. Bruce Hamburg

[57] ABSTRACT

A lady's handbag adapted to be carried with improved security. The handbag includes a main article-carrying bag-shaped portion. Secured to the main portion near corners thereof is a strap adapted to be carried over the back of the wearer's neck. The main portion has an exterior face adapted to face the front of the wearer's torso when the handbag is carried with the strap over the back of the wearer's neck. Provided on that exterior face are means forming pockets for receiving both of the wearer's hands when the handbag is carried with the strap over the back of the wearer's neck. Also provided is a pair of loops and means fastening the loops in front of the aforementioned face, the loops being adapted to receive a belt worn by the wearer.

4 Claims, 2 Drawing Figures

LADY'S HANDBAG

BACKGROUND OF THE INVENTION AND PRIOR ART STATEMENT

This invention relates to a lady's handbag adapted to be carried with improved security.

Purse-snatching is an unfortunate aspect of modern urban life. Accordingly, there is considerable demand for ladies' handbags which are not only stylish but can be carried with improved security. Moreover, it is desired that a lady's handbag be adaptable to carry as many everyday items as possible.

It is therefore an object of the present invention to provide such a handbag.

In the prior art, there is known the concept of a combination handbag and muff, as illustrated, for example, by U.S. Design Pat. Nos. 115,369 and 123,010. In U.S. Design Pat. No. 115,369, moreover, the combination handbag-muff includes a long strap which appears to be intended to be worn around the neck. The hand-receiving portions of these combination handbag-muffs are at the centers of obviously heavy constructions, since warmth of the user's hands is the prime objective. These items are, therefore, quite unsuitable for use under conditions other than rather cold weather. Moreover, these items are not specifically adapted for improved security purposes and, therefore, do not have all the safeguards that one might want for a handbag designed for improved security. Morever, relatively large articles, such as non-collapsing umbrellas, cannot be carried by means of these items.

SUMMARY OF THE INVENTION

According to the invention, there is provided a lady's handbag adapted to be carried with improved security. The handbag includes a main article-carrying bag-shaped portion. Secured to the main portion near corners thereof is a strap adapted to be carried over the back of the wearer's neck. In other words, by means of the strap the bag is slung over the wearer's neck with the main portion hanging in front of the wearer's torso. The main portion has an exterior face adapted to face the front of the wearer's torso when the handbag is worn in the manner described. On that face are means forming pockets for receiving both of the wearer's hands when the bag is worn in the aforementioned manner. In front of the aforementioned face is also provided a pair of loops. The loops are adapted to receive a belt worn by the wearer.

The handbag may also include a packet fastened to the strap, being of a suitable size, for example, to hold a security device or a pack of cigarettes. Moreover, a hook may also be provided on the handbag, for example on the aforementioned face. Such a hook is particularly useful for engaging the loop which is specifically provided at the handle of an umbrella, whereby the umbrella may be held by a handbag according to the invention without engaging a hand of the person wearing the handbag.

DETAILED DESCRIPTION OF A PREFERRED EMBODIMENT

Figure 1:
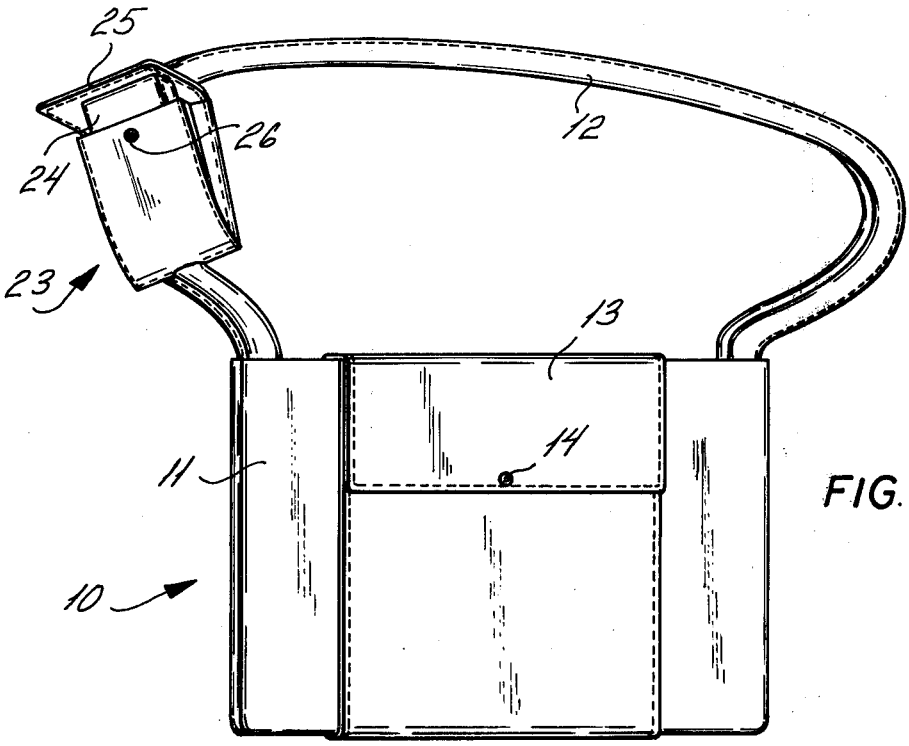
FIG. 1 is a front view of a handbag according to the invention.
Figure 2:
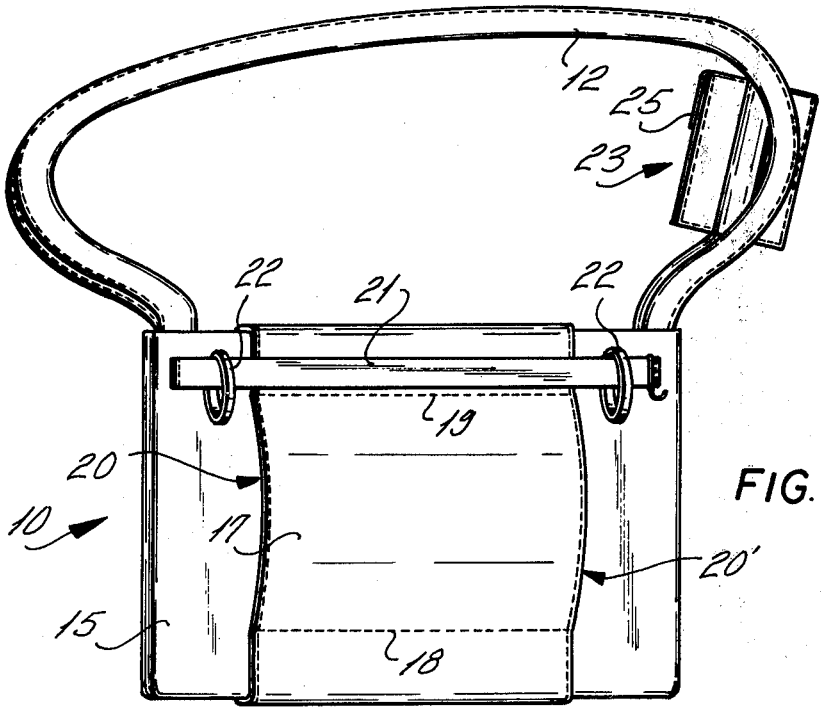
FIG. 2 is a rear view of a handbag according to the invention.

A handbag according to the invention includes a main article-carrying bag-shaped portion 11. Fastened to the main portion 11 near corners thereof is a strap 12 adapted to be carried over the back of the wearer's neck. A flap 13 provided with a conventional closure 14 seals the otherwise open top of the main portion 11.

The rear exterior face 15 of the main portion 11 faces the wearer's torso when the handbag is worn in the aforedescribed manner. This rear face 15 is utilized for additional security devices. Fastened to the rear face 15 by means of stitched horizontal seams 18 and 19 is a rectangular piece of material, such as leather, vinyl, or fabric, of which the handbag is fabricated. The material is not drawn tightly across the face 15, but, rather, is left sufficiently slack so that with the face 15 it forms a continuous pocket, which, effectively, is two pockets, the wearer's left hand being received in the left end opening thereof at 20 and the wearer's right hand being received in the right end opening thereof at 20'. The horizontal stitches in the material 17 adjacent the openings 20 and 20' are not seams but, rather, are hems or bindings finishing the free edges of the material 17.

A band 21 extends substantially across the width of the face 15, being fastened at its ends to the face 15. A pair of loops 22 is slidably carried on the band 21. A belt worn on a garment by wearer may be passed through the loops 22.

The combination of the strap 12 carried over the wearer's neck, the loops 22 being engaged by the wearer's belt and the hand-receiving pockets formed at the rear exterior face of the bag assures an unusually high degree of security.

A small packet 23, suitable, for example, for carrying a security device or a pack of cigarettes 24 (shown, for illustrative purposes, partly exposed in FIG. 1) and provided with a flap 25 and conventional closure 26 may be fastened to the strap 12.

What I claim is:

1. A lady's handbag adapted to be carried with improved security, comprising a main article-carrying bag-shaped portion, secured to said main portion near corners thereof a strap adapted to be carried over the back of the wearer's neck, the main portion having an exterior face adapted to face the front of the wearer's torso when the handbag is carried with the strap over the back of the wearer's neck, means forming pockets on said face for receiving both of the wearer's hands when the handbag is carried with the strap over the back of the wearer's neck, a pair of loops, and means fastening said loops in front of said face, said loops being adapted to receive a belt worn by said wearer.

2. A handbag according to claim 1, further comprising a packet fastened to said strap.

3. A handbag according to claim 2, further comprising a hook and means fastening the hook to said main portion.

4. A handbag according to claim 3, in which said means fastening said loops and said means fastening said hook both constitute a single band fastened at its ends to said face and extending substantially across the width of said main portion.

* * * * *